US005791890A

United States Patent [19]

Maughan

[11] Patent Number: 5,791,890

[45] Date of Patent: Aug. 11, 1998

[54] GAS OVEN CONTROL WITH PROOF OF IGNITION

[75] Inventor: James Rollins Maughan, Scotia, N.Y.

[73] Assignee: General Electric Company, Schenectady, N.Y.

[21] Appl. No.: 950,807

[22] Filed: Nov. 4, 1997

Related U.S. Application Data

[63] Continuation of Ser. No. 516,595, Aug. 18, 1995, abandoned.

[51] Int. Cl.[6] ..... F23N 5/20

[52] U.S. Cl. ..... 431/6; 431/18; 431/80; 126/19 R; 126/39 E

[58] Field of Search ..... 431/6, 75, 80, 431/18, 281; 126/19 R, 39 E

[56] References Cited

U.S. PATENT DOCUMENTS

| | | | |
|---|---|---|---|
| 2,361,530 | 10/1944 | Burch | 177/311 |
| 3,174,534 | 3/1965 | Weber | 158/125 |
| 3,551,083 | 12/1970 | Michaels | 431/66 |
| 3,558,110 | 1/1971 | Kushner | 263/10 |
| 3,566,151 | 2/1971 | Wilburn . | |
| 3,589,847 | 6/1971 | Osborne | 431/69 |
| 3,676,042 | 7/1972 | Osborne | 431/66 |
| 3,818,285 | 6/1974 | Carson et al. . | |
| 3,938,937 | 2/1976 | Matthews | 431/78 |
| 3,963,410 | 6/1976 | Baysinger | 431/46 |
| 4,125,357 | 11/1978 | Kristen et al. | 431/78 |
| 4,235,587 | 11/1980 | Miles . | |
| 4,249,884 | 2/1981 | Cade | 431/31 |
| 4,257,758 | 3/1981 | Blomberg | 431/27 |
| 4,402,663 | 9/1983 | Romanelli et al. . | |
| 4,445,638 | 5/1984 | Connell et al. . | |
| 4,502,625 | 3/1985 | Mueller | 236/11 |
| 4,854,852 | 8/1989 | Patton et al. | 431/78 |
| 4,984,736 | 1/1991 | Reiser et al. . | |
| 4,993,401 | 2/1991 | Diekmann et al. . | |
| 5,181,846 | 1/1993 | Chang | 431/80 |
| 5,189,963 | 3/1993 | Mann . | |
| 5,351,632 | 10/1994 | Mann . | |
| 5,403,183 | 4/1995 | Andersson et al. | 431/80 |
| 5,655,900 | 8/1997 | Cacciatore . | |

*Primary Examiner*—Carl D. Price

*Attorney, Agent, or Firm*—Patrick K. Patnode; Marvin Snyder

[57] ABSTRACT

A gas oven having an electronic controller for directly controlling the gas valve and burner ignition. The controller opens the gas valve and activates the ignitor whenever oven heating is required and then determines whether ignition has occurred, detected by an indicator of ignition, often a conventional oven thermostat, a thermocouple, a resistance temperature device (RTD), or other type of temperature sensor. Positive proof of ignition is given by determining whether the detected temperature is increasing at a particular rate. The gas valve is closed if ignition does not occur within a predetermined time, preferably about 10–15 seconds. Re-ignition may be attempted after a sufficient delay. The controller also closes the gas valve whenever the oven temperature is decreasing at a predetermined rate or is increasing at less than a predetermined rate.

12 Claims, 3 Drawing Sheets

GAS OVEN CONTROL WITH PROOF OF IGNITION

This application is a Continuation of application Ser. No. 08/516,595 filed Aug. 18, 1995, now abandoned.

BACKGROUND OF THE INVENTION

This invention relates generally to gas ovens and more particularly to control and ignition systems for gas ovens.

Household gas ovens typically have one or more gas burners positioned to heat the oven chamber. Conventional ignition systems incorporate a hot surface ignitor, referred to as a glowbar, in conjunction with a thermally operated gas control valve. By design, the thermostatic gas valve opens only when a specified current has been established through the glowbar. The specified current is such that the glowbar is presumed to be hot enough to cause ignition. However, this system does not provide positive proof of ignition. Misalignment of the glowbar can be severe enough to delay or prevent ignition, presenting a safety concern. In addition, glowbar ignitors are costly and subject to breakage. Thermostatic gas control valves are also relatively expensive.

Accordingly, there is a need for gas oven ignition systems which are simpler, safer, more reliable, and more cost effective to operate.

SUMMARY OF THE INVENTION

The above-mentioned needs are met by the present invention which provides a gas oven having a gas valve, a burner, an ignitor, one or more indicators of ignition, an electronic controller and a method for controlling the oven in which the gas valve is controlled directly by the controller and ignition is independent of gas control.

In a preferred embodiment of the instant invention, a temperature sensor, located adjacent said burner, is included as the primary indicator of ignition, with a conventional oven thermostat being relegated to a secondary indicator of ignition.

In a second preferred embodiment, first and second temperature sensors are positioned adjacent to a baking burner and a broiling burner, respectively. Said first and second temperature sensors are included as the primary indicators of ignition, with a conventional oven thermostat being relegated to a secondary indicator of ignition.

In each embodiment of the instant invention, the electronic controller opens the gas valve and activates the ignitor whenever oven heating is required and then determines whether ignition has occurred. The gas valve is closed if ignition does not occur within a predetermined time, preferably 10–15 seconds. Re-ignition may be attempted after a sufficient delay, preferably 30–60 seconds.

In the instant invention, positive proof of ignition is given by determining whether an indicator of ignition detects that the temperature within the oven is increasing at a predetermined rate or greater. The electronic controller also closes the gas valve whenever an indicator of ignition establishes the temperature within the oven is decreasing at a predetermined rate or not increasing at a high enough rate.

This positive proof of ignition provides improved reliability and safety over conventional ovens. Additionally, the instant invention allows the use of less expensive components such as high voltage spark ignitors and solenoid valves to be used within the gas oven assembly.

The preferred apparatus and method for gas oven fuel control with proof of ignition, offers the following advantages: good economy; improved safety; ease of use; excellent speed; and positive proof of ignition. In fact, in many of the preferred embodiments, these factors of economy, use, safety, and proof of ignition, are optimized to an extent considerably higher than heretofore achieved in prior, known apparatuses and methods for gas oven fuel control.

Other objects and advantages of the instant invention will become apparent upon reading the following detailed description and the appended claims with reference to the accompanying drawings.

BRIEF DESCRIPTION OF THE DRAWINGS

The subject matter which is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
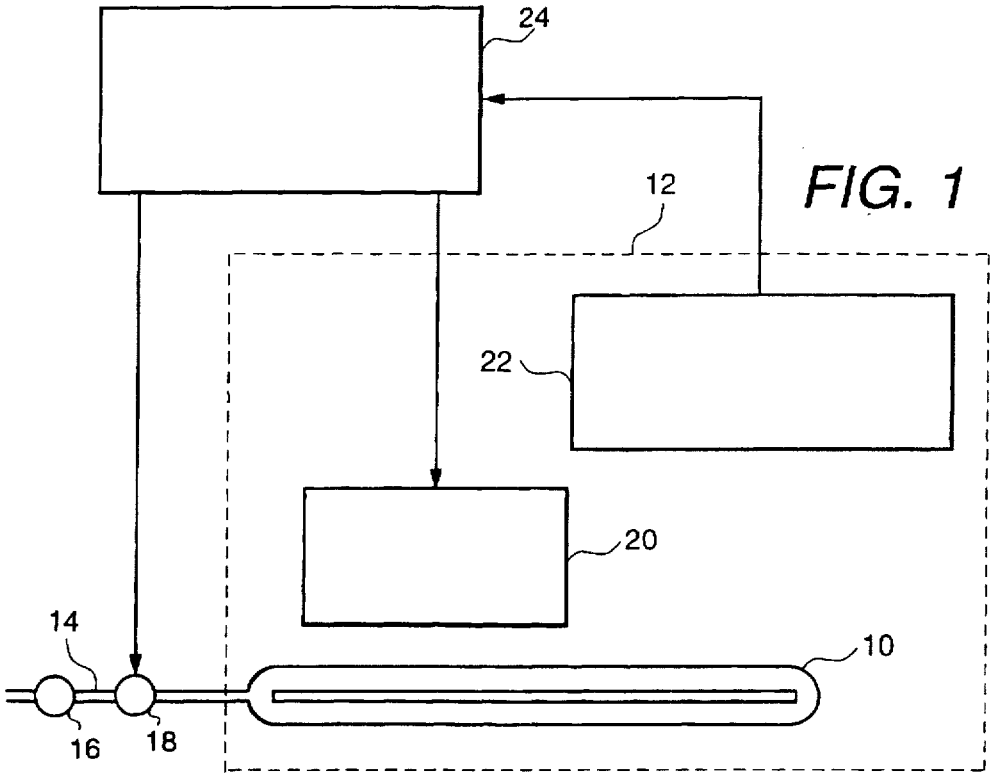
FIG. 1 is a simplified block diagram of a gas oven in accordance with the instant invention.

Referring to the drawings, FIG. 1 is a block diagram representation of a gas oven in accordance with the instant invention. A gas burner 10 is located within the oven chamber 12 (shown in dotted lines), and a gas line 14 is connected to the burner 10. A conventional gas regulator 16 and a gas control valve 18 are provided in line 14 so that gas is delivered to the burner 10 when the gas valve 18 is open. Gas flow to the burner 10 is prevented when the valve 18 is closed. The gas valve 18 can be any type of suitable valve, a solenoid valve is one preferred valve because it is reliable, relatively inexpensive and has a quick response time.

An ignitor 20 is located adjacent said burner 10. The ignitor 20 can be any suitable type of ignition device, such as a spark ignitor or a hot surface ignitor.

An electronic range controller 24 is provided for controlling the operation of the oven. Electronic range controllers 24 in general are commonly used in gas cooking appliances and are well known in the art. The electronic range controller 24 has an input connected to an indicator of ignition 22 and outputs connected to the gas valve 18 and the ignitor 20. Thus, the electronic range controller 24 is able to control the opening and closing of the gas valve 18 as well as the energization of the ignitor 20. The electronic range controller 24 also receives input from a user-operated control knob (not shown) which sets the desired temperature at which the oven is to operate.

Said indicator of ignition 22, often a conventional oven thermostat, a thermocouple, a resistance temperature device (RTD), or other type of temperature sensor, is located within the oven chamber 12 to sense temperature. The electronic range controller 24 monitors the temperature detected by the indicator of ignition 22. Increasing temperature at a predetermined rate or greater indicates that flames are present and ignition has occurred and the gas valve 18 should remain open.

If ignition has not occurred, the electronic range controller 24 monitors the time that the gas valve 18 has been open. If the elapsed time exceeds a predetermined time then the electronic range controller 24, as a safety precaution, will close gas valve 18 for a short time before attempting re-ignition. Once ignition occurs, the electronic range controller 24 continuously monitors the temperature detected by the indicator of ignition 22. A decreasing temperature at a predetermined rate or greater or an increase in temperature at less than a predetermined rate, indicates flameout or burner extinction has occurred and the gas valve 18 will be closed by the electronic range controller 24.

Figure 4:
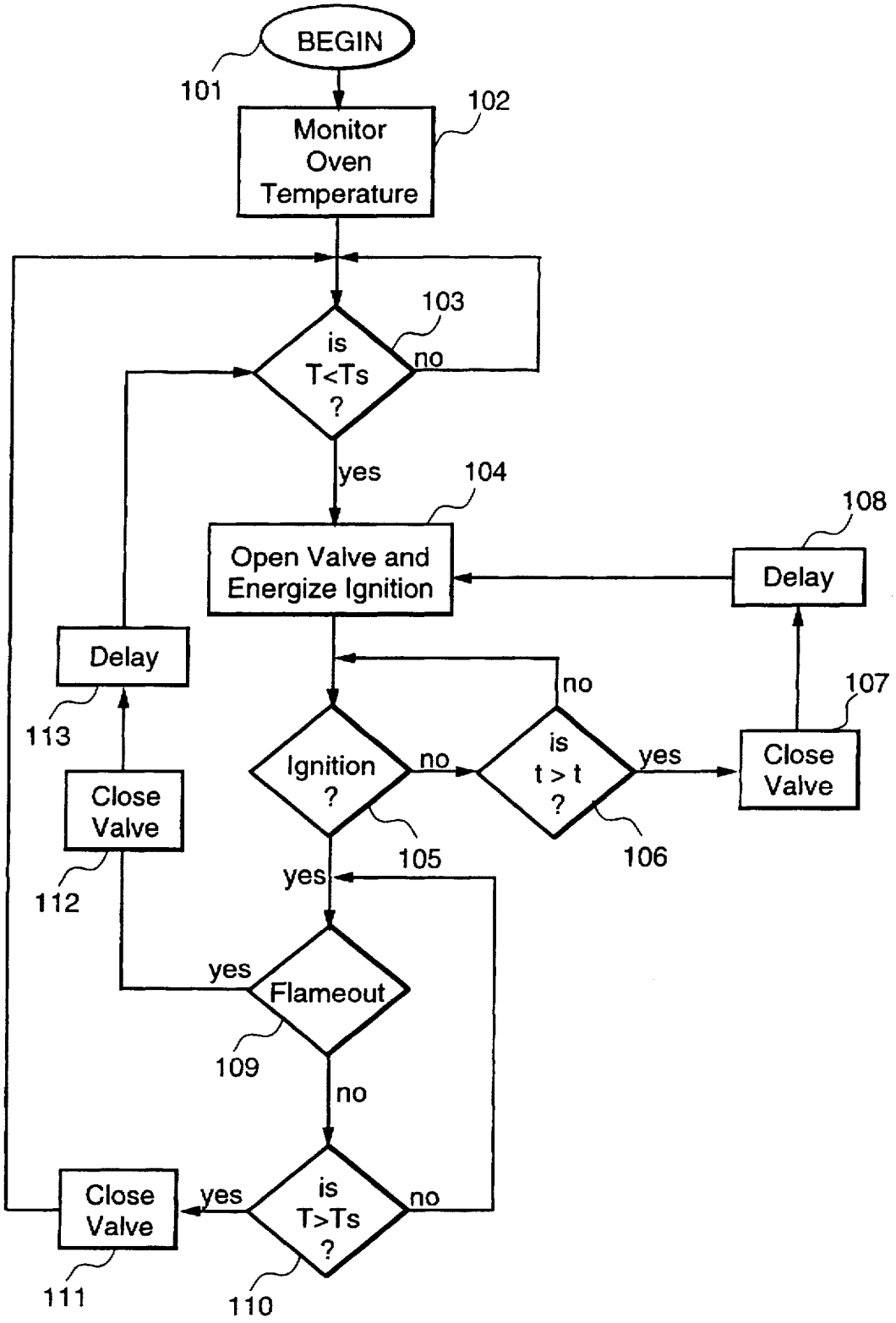
FIG. 4 is a flow chart which illustrates the control method of the instant invention.

In one preferred embodiment, the electronic range controller 24 comprises a conventional control device such as a microprocessor which is programmed to regulate operation of the gas oven in the manner illustrated by the flow chart of FIG. 4.

Figure 2:
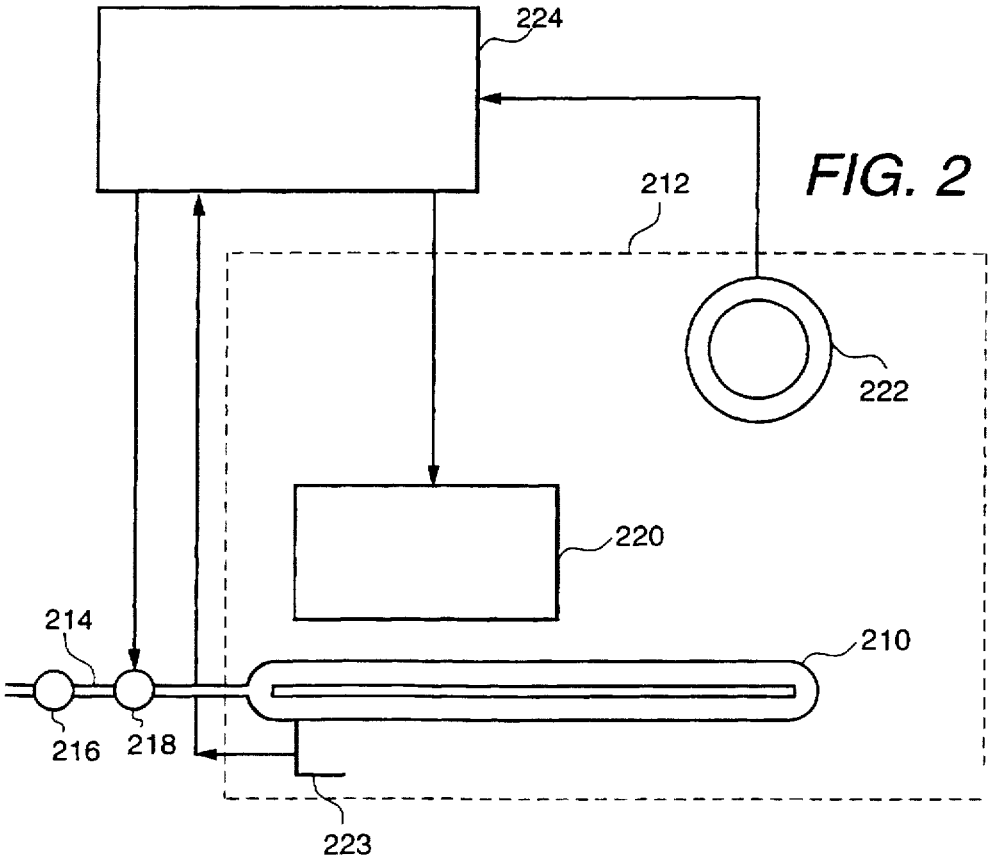
FIG. 2 is a simplified block diagram of a preferred embodiment of a gas oven in accordance with the instant invention.

FIG. 2 is a block diagram representation of a gas oven in accordance with a preferred embodiment of the instant invention. A gas burner 210 is located within oven chamber 212 (shown in dotted lines), and a gas line 214 is connected to said gas burner 210. A conventional gas regulator 216 and a gas control valve 218 are provided in line 214 so that gas is delivered to the burner 210 when the gas valve 218 is open. Gas flow to the burner 210 is prevented when the valve 218 is closed. The gas valve 218 can be any type of suitable valve, a solenoid valve is one preferred valve because it is reliable, relatively inexpensive, and has a quick response time.

An ignitor 220 is located adjacent said burner 210. The ignitor 220 can be any suitable type of ignition device, such as a high voltage spark ignitor or a hot surface ignitor.

An electronic range controller 224 is provided for controlling the operation of the oven. Electronic range controllers in general are commonly used in gas cooking appliances and are well known in the art. The electronic range controller 224 has an input connected to a temperature sensor 223 and a conventional oven thermostat 222 and outputs connected to the gas valve 218 and the ignitor 220. Thus, the electronic range controller 224 is able to control the opening and closing of the gas valve 218 as well as the energization of the ignitor 220. The electronic range controller 224 also receives input from a user-operated control knob (not shown) which sets the desired temperature at which the oven is to operate.

Said conventional oven thermostat 222 is located within said oven chamber 212 to sense temperature. Additionally, said temperature sensor 223, preferably a thermocouple or a resistance temperature device (RTD), is positioned adjacent said burner 210. Said temperature sensor 223 is the primary indicator of ignition within the instant embodiment, with the conventional oven thermostat 222 being relegated to a secondary indicator of ignition.

The electronic range controller 224 monitors the temperature detected by temperature sensor 223 and oven thermostat 222. Increasing temperature at a predetermined rate or greater indicates that flames are present and ignition has occurred and the gas valve 218 should remain open. The electronic range controller 224, first monitors the temperature sensor 223 for indication of ignition. If the temperature sensor 223 fails to operate or fails to detect a temperature change, the electronic range controller 224 monitors the conventional oven thermostat 222 as a secondary indicator of ignition.

If ignition has not occurred, the electronic range controller 224 monitors the time that the gas valve 218 has been open. If the elapsed time exceeds a predetermined time then the electronic range controller 224, as a safety precaution, will close the gas valve 218 for a short time before attempting re-ignition. Once ignition occurs, the electronic range controller 224 continuously monitors the temperature detected by the temperature sensor 223 and the oven thermostat 222. A decreasing temperature at a predetermined rate or greater or an increase in temperature at less than a predetermined rate, indicates flameout or burner extinction has occurred and the gas valve 218 will be closed by the electronic range controller.

In one preferred embodiment, the electronic range controller 224 comprises a conventional control device such as a microprocessor which is programmed to regulate operation of the gas oven in the manner illustrated by the flow chart of FIG. 4.

It is important to note that since such ignition detecting temperature sensors only detect temperature changes, the accuracy and long term stability required of oven thermostats is not needed.

Figure 3:
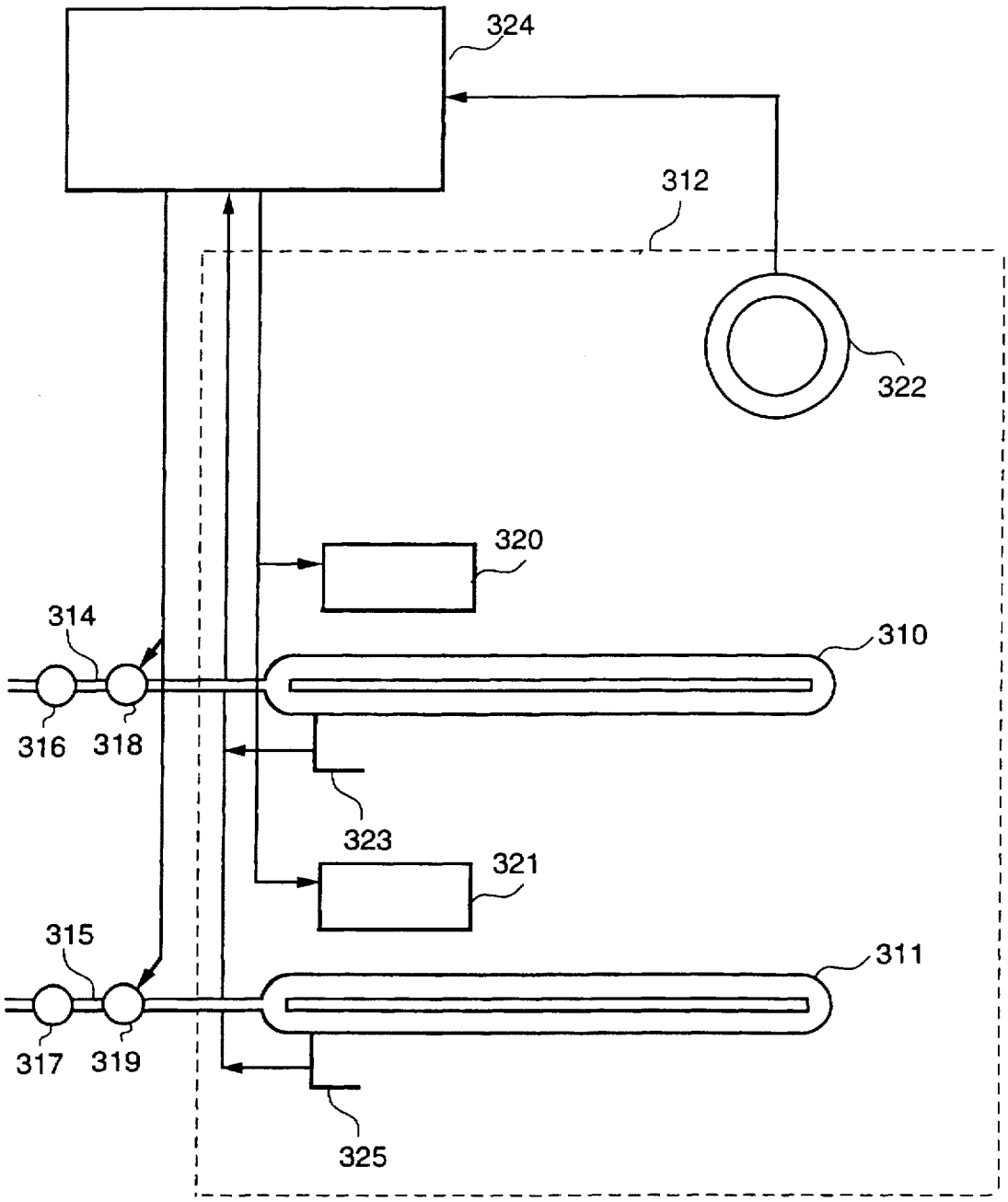
FIG. 3 is a simplified block diagram of a second preferred embodiment of a gas oven in accordance with the instant invention.

FIG. 3 is a block diagram representation of a gas oven in accordance with a second preferred embodiment of the instant invention. A broiling burner 310 and a baking burner 311 are located within the oven chamber 312 (shown in dotted lines), and gas lines 314 and 315 are connected to the broiling burner 310 and the baking burner 311, respectively. Conventional gas regulators 316 and 317 and gas control valves 318 and 319 are provided in gas line 314 and gas line 315, respectively, so that gas is delivered to the broiling burner 310, when gas valve 318 is open, and to the baking burner 311, when gas valve 319 is open. Gas flow to either the broiling burner 310 or the baking burner 311 is prevented when the valves 318 and 319 are closed. The gas valves 318 and 319 can be any type of suitable valve, a solenoid valve is one preferred valve because it is reliable, relatively inexpensive and has a quick response time.

Ignitors 320 and 321 are located adjacent said broiling burner 310 and said baking burner 311, respectively. The ignitors 320 and 321 can be any suitable type of ignition device, such as a high voltage spark ignitor or a hot surface ignitor.

An electronic range controller 324 is provided for controlling the operation of the oven. Electronic range controllers in general are commonly used in gas cooking appliances and are well known in the art. The electronic range controller 324 has an input connected to a pair of temperature sensors 323, 325 and to a conventional oven thermostat 322 and outputs connected to the gas valves 318, 319 and the ignitors 320 and 321. Thus, the electronic range controller 324 is able to control the opening and closing of the gas valves 318 and 319 as well as the energization of the ignitors 320 and 321. The electronic range controller 324 also receives input from a user-operated control knob (not shown) which sets the desired temperature at which the oven is to operate.

Said conventional oven thermostat 322 is located within said oven chamber 312 to sense temperature. Additionally, said temperature sensors 323 and 325, preferably thermocouples or resistance temperature devices (RTD), are positioned adjacent said broiling burner 310 and said baking burner 311, respectively. Said temperature sensors 323 and 325 are the primary indicators of ignition within the instant embodiment, with the conventional oven thermostat 322 being relegated to a secondary indicator of ignition.

The electronic range controller 24 monitors the temperature detected by the temperature sensors 323 and 325 and by the conventional oven thermostat 322. Increasing temperature at a predetermined rate or greater indicates that flames are present and ignition has occurred and either gas valve 318 or 319 should remain open, depending on whether the broiling burner 310 or the baking burner 311 is in use. The electronic range controller 324, first monitors the temperature sensors 323 and 325 for indication of ignition. The temperature sensors 323 and 325 may be connected in series with the electronic range controller 324, such that a temperature change established by either sensor would be detected, irrespective of whether the broiling burner 310 or the baking burner 311 were in use. If the temperature sensors 323 and 325 fail to operate or fail to detect a temperature change, the electronic range controller 324 monitors the conventional oven thermostat 322 as a secondary indicator of ignition.

If ignition has not occurred, the electronic range controller 324 monitors the time that gas valve 318 or gas valve 319 has been open. If the elapsed time exceeds a predetermined time then the electronic range controller 324 will close the gas valve currently in use, 318 or 319, as a safety precaution, for a short time before attempting re-ignition. Once ignition occurs, the electronic range controller 324 continuously monitors the temperature detected by the temperature sensors 323 and 325 and the oven thermostat 322. A decreasing temperature at a predetermined rate or greater or an increase in temperature at less than a predetermined rate, indicates flameout or burner extinction has occurred and the gas valve currently in use, either 318 or 319, will be closed.

In one preferred embodiment, the electronic range controller 324 comprises a conventional control device such as a microprocessor which is programmed to regulate operation of the gas oven in the manner illustrated by the flow chart of FIG. 4.

Referring now to FIG. 4, the control sequence of the electronic range controller begins when the gas oven is turned on by a user as indicated at block 101. The user sets the desired oven temperature, referred to herein as the preset temperature, $T_s$. Once initiated, the electronic range controller monitors the oven temperature detected by the oven thermostat as indicated at block 102. The electronic range controller continuously monitors the oven temperature as long as the oven is operating.

At block 103, the electronic range controller determines whether the oven temperature, T, is below the preset temperature, $T_s$. If not, then the electronic range controller simply continues to monitor oven temperature. But if the oven temperature, T, is below the preset temperature $T_s$ (i.e., oven heating is required), then the electronic range controller will cause the gas valve to open and the ignitor to be energized as indicated at block 104. If a high voltage ignitor is used, the it is energized for about 2 seconds approximately one second after the gas valve is opened. A high voltage spark ignitor provides the advantage of being rapidly energized and de-energized. Thus, no ignition source is present if ignition fails. If the ignitor is a hot surface ignitor, then the opening of the valve will be delayed until the ignitor is hot enough to cause ignition.

Next, the electronic range controller determines whether ignition of the burner has occurred at block 105. The electronic range controller monitors the temperature detected by the indicator of ignition. Increasing temperature at a predetermined rate indicates that flames are present and ignition has occurred.

If ignition has not occurred, the electronic range controller monitors the elapsed time, t, from when the valve was opened at block 106. As long as the elapsed time, t, does not exceed a predetermined time, $t_i$, then the electronic range controller simply continues to monitor whether burner ignition has occurred. But if the elapsed time exceeds the predetermined time, $t_i$, and ignition has not occurred, then, as indicated at block 107, the electronic range controller will close the gas valve as a safety precaution. The predetermined time, ti, should be at least 10–15 seconds to ensure safe operation. After such a closing of the gas valve, the electronic range controller will attempt re-ignition (return to block 104) after a sufficient time delay (block 108) to purge any gas that may have accumulated while the valve was open. Generally, the time delay should be about 30–60 seconds depending on how long the valve is left open (i.e., the longer the valve is open, the more purge time will be needed).

Once ignition does occur, the temperature detected by the indicator of ignition is continuously monitored at block 109 to determine whether flameout or burner extinction has occurred. Flameout is indicated if the temperature detected by the indicator of ignition is decreasing at a predetermined rate or greater or is increasing at less than a predetermined rate.

If flameout is detected at block 109, the electronic range controller will monitor the oven temperature, T, to see whether it is below the preset oven temperature, $T_s$ (return to block 103) after the valve is closed at block 112 and a sufficient time delay at block 113, to purge any gas that may have accumulated while the valve was open.

If flameout is not detected at block 109, then the oven temperature, T, is monitored at block 110 to see whether it has exceeded the preset temperature, $T_s$. If the oven temperature, T, is greater than the preset temperature $T_s$, then the oven heating has been satisfied and the valve is closed as indicated at block 111.

After the valve is closed at block 111, the electronic range controller continues to monitor the oven temperature T (return to block 103) and if the oven temperature, T, falls below the preset temperature, $T_s$, due to cooling, the heating process will be repeated. Thus, the control sequence of the present invention is a closed loop which continues until such time that the oven is turned off.

The foregoing has described an ignition system for gas ovens which is simpler, safer and more reliable to operate. While specific embodiments of the present invention have been described, it will be apparent to those skilled in the art that various modifications thereto can be made without departing from the spirit and scope of the invention as defined in the appended claims.

What is claimed is:

1. A gas oven comprising:

a broiling burner;

a baking burner;

a first gas valve connected to said broiling burner and a second gas valve connected to said baking burner;

a first ignitor situated adjacent said broiling burner and a second ignitor situated adjacent said baking burner;

a first temperature sensor situated adjacent said broiling burner to detect temperature;

a second temperature sensor situated adjacent said baking burner to detect temperature; and a controller having an input connected to said first and second temperature sensors and outputs connected to said gas valves and said ignitors, said controller being responsive to said temperature sensors so as to cause said gas valves to close whenever the detected temperature does not increase at at least a predetermined rate within a first predetermined time after said gas valves are opened.

2. The gas oven of claim 1 wherein said controller is further responsive to said first and second temperature sensors so as to cause said gas valves to close whenever said temperature sensors detect a temperature decrease at at least a predetermined rate or an increase in temperature at less than a predetermined rate.

3. The gas oven of claim 1 wherein said first and second temperature sensors are connected in series with said controller.

4. The gas oven of claim 1 wherein said first predetermined time is 10–15 seconds.

5. The gas oven of claim 1 wherein said first and second gas valves are solenoid valves.

6. The gas oven of claim 1 wherein said first and second ignitors are high voltage spark ignitors.

7. The gas oven of claim 1 wherein said first and second ignitors are hot surface ignitors.

8. The gas oven of claim 1 wherein said first and second temperature sensors are thermocouples.

9. The gas oven of claim 1 wherein said first and second temperature sensors are resistance temperature devices.

10. The gas open of claim 1 further comprising a conventional oven thermostat wherein said first and second temperature sensors are the primary indicators of ignition and the conventional oven thermostat is the secondary indicator of ignition.

11. The gas oven of claim 1 wherein said controller is an electronic range controller comprising a microprocessor which is programmed to regulate operation of said gas oven in the following manner:

monitoring the gas oven temperature to determine if the oven temperature has reached a preset temperature;

opening the gas valve and energizing the ignitor if the oven temperature has not reached the preset temperature;

attempting to ignite the selected burner;

monitoring the temperature sensors for positive proof of burner ignition;

monitoring the temperature sensors to check for flameout once proof of burner ignition is received from said temperature sensors; and heating the gas oven until the gas oven temperature has reached the preset temperature and returning to the first step of monitoring the gas oven temperature to determine if the oven temperature has reached the preset temperature.

12. The gas oven of claim 11 further comprising the steps of:

monitoring the elapsed time that the gas valves are opened;

closing the gas valves if the temperature sensors do not detect burner ignition after a predetermined time; and attempting re-ignition after a time delay.

* * * * *